US009051925B2

(12) United States Patent
Park et al.

(10) Patent No.: US 9,051,925 B2
(45) Date of Patent: Jun. 9, 2015

(54) FUEL INJECTION PUMP INCLUDING A VARIABLE PRESSURE COMPARTMENT

(75) Inventors: Deuk-Jin Park, Ulsan (KR); Ju-Tae Kim, Ulsan (KR); Dong-Hun Kim, Ulsan (KR); Wook-Hyeon Yoon, Ulsan (KR); Byong-Seok Kim, Ulsan (KR); Tae-Hyung Park, Ulsan (KR); Eun Ha, Ulsan (KR); Beom-Yong No, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 369 days.

(21) Appl. No.: 13/819,005

(22) PCT Filed: Mar. 21, 2011

(86) PCT No.: PCT/KR2011/001917

§ 371 (c)(1),
(2), (4) Date: Feb. 26, 2013

(87) PCT Pub. No.: WO2012/053706

PCT Pub. Date: Apr. 26, 2012

(65) Prior Publication Data

US 2013/0156620 A1 Jun. 20, 2013

(30) Foreign Application Priority Data

Oct. 20, 2010 (KR) ..... 10-2010-0102372

(51) Int. Cl.
*F02M 59/20* (2006.01)
*F04B 7/00* (2006.01)
(Continued)

(52) U.S. Cl.
CPC ..... *F04B 7/00* (2013.01); *F02M 59/022* (2013.01); *F02M 59/20* (2013.01); *F02M 59/205* (2013.01); *F02M 59/22* (2013.01); *F02M 59/462* (2013.01); *F04B 49/12* (2013.01)

(58) Field of Classification Search
CPC ..... F04B 11/00–11/0033; F04B 39/0066; F04B 39/0088; F04B 7/00; F04B 7/02; F16L 55/04; F02M 59/00; F02M 59/02; F02M 59/022; F02M 59/025; F02M 59/20; F02M 59/32
See application file for complete search history.

(56) References Cited

U.S. PATENT DOCUMENTS 2,055,578 A * 9/1936 Hurst ..... 123/512
2,071,237 A * 2/1937 Rupprecht ..... 239/90
(Continued)

FOREIGN PATENT DOCUMENTS

DE EP0971122 A2 * 1/2000
GB 1470152 A * 4/1977
(Continued)

*Primary Examiner* — Devon Kramer
*Assistant Examiner* — Nathan Zollinger
(74) *Attorney, Agent, or Firm* — Rabin & Berdo, P.C.

(57) ABSTRACT

A fuel injection pump having a variable pressure chamber which can adjust a fuel injection timing according to each engine load with a simple structure and a lower manufacture cost compared to the conventional injection pump without a separate apparatus for moving a barrel as well as not modifying a shape of a plunger.

The fuel injection pump having the variable pressure chamber further includes a pressure adjustment mechanism including a contact plug of which lower portion is inserted and installed in the upper cover; a cylinder of which lower portion is inserted and installed in the contact plug and having the variable pressure chamber formed inside thereof; a main fuel pressing hole formed in the upper cover and the barrel to connect the variable pressure chamber of the cylinder and a plunger insertion hole of the barrel; a piston installed in the variable pressure chamber of the cylinder to enable an upward and downward sliding motion thereof; and a manual pressure adjustment unit installed on an upper portion of the cylinder to enable a vertical height adjustment to elastically support the upper portion of the piston.

4 Claims, 4 Drawing Sheets

(51) Int. Cl.

| | |
|---|---|
| ***F02M 59/02*** | (2006.01) |
| ***F02M 59/22*** | (2006.01) |
| ***F02M 59/46*** | (2006.01) |
| ***F04B 49/12*** | (2006.01) |

(56) References Cited

U.S. PATENT DOCUMENTS 5,197,437 A * 3/1993 Dahlmann ..... 123/467
5,291,867 A 3/1994 Hummel et al.

FOREIGN PATENT DOCUMENTS

| | | | |
|---|---|---|---|
| JP | 02-070972 | A | 3/1990 |
| JP | 06-050179 | A | 2/1994 |
| JP | 2000-130281 | A | 5/2000 |
| JP | 2007-127002 | A | 5/2007 |
| JP | 2010-159651 | A | 7/2010 |
| KR | 20-1998-038352 | U | 9/1998 |

* cited by examiner

FUEL INJECTION PUMP INCLUDING A VARIABLE PRESSURE COMPARTMENT

TECHNICAL FIELD

The present invention relates to a fuel injection pump having a variable pressure chamber and, more particularly, to a fuel injection pump having a variable pressure chamber in which a pressure of the variable pressure chamber, which can adjust a distance of an upward and downward reciprocating motion of a piston, is adjusted through a manual pressure adjustment unit or an automatic pressure adjustment unit to adjust a volume of the variable pressure chamber such that a fuel injection timing is delayed or advanced to improve fuel efficiency as well as generation of NOx is reduced while smog which is a harmful gas is reduced at the same time.

BACKGROUND ART

Hereinafter, the background art and its problem will be described.

Generally, in a fuel injection pump used in a marine engine, an ignition delay phenomenon may occur due to a use of bunker-C (HFO) having a different viscosity for each fuel such that compensation is needed for a combustion loss, and a technique for compensating the combustion loss is, in a large sense, collectively called as a variable injection timing (VIT) technique and, in substance, refers to a technique which achieves optimized combustion by performing compensation using fuel quality setting (FQS).

The VIT or the FQS described above is used for purpose of reducing a fuel cost while improving combustion efficiency by increasing a maximum combustion pressure within a combustion cylinder.

Generally, the VIT may automatically adjust an injection timing during an operation of an engine and allows optimal fuel consumption at a low load.

Generally, in a fuel injection pump of a bosch type, a plunger blocks a spill port of a barrel such that a pressure of fuel begins to rise and fuel of a high pressure is injected, and in this case, in order to control a fuel injection start timing, a location of the spill port formed on the barrel is adjusted vertically or a shape of the plunger is modified according to a load.

However, in the general conventional VIT technique which adjusts a fuel injection timing, a separate apparatus having a complex structure which changes the location of the spill port of the barrel needs to be installed or the shape of the plunger is modified in complexity such that, when the plunger is worn out or a material property of the fuel, a problem exists in that the fuel injection timing is changed and the fuel injection timing is difficult to be controlled externally.

DISCLOSURE

Technical Problem

Therefore, an objective of the present invention is to provide a fuel injection pump having a variable pressure chamber which can adjust a fuel injection timing according to each engine load with a simple structure and a lower manufacture cost compared to the conventional injection pump without modifying a shape of a plunger as well as obviating a separate apparatus for moving a barrel.

Technical Solution

The present invention directed to achieve the above objective includes a barrel inserted and installed within a pump housing; a plunger slidably coupled to an inside of the barrel; and an upper cover coupled to an upper surface of the pump housing, wherein the plunger closes a discharge hole of the barrel to begin a pressure increase of fuel to inject high pressure fuel, the fuel injection pump further including: a pressure adjustment means comprising: a contact plug of which lower portion is inserted and installed in the upper cover; a cylinder of which lower portion is inserted and installed in the contact plug and having the variable pressure chamber formed inside thereof; a main fuel pressing hole formed in the upper cover and the barrel to connect the variable pressure chamber of the cylinder and a plunger insertion hole of the barrel; a piston installed in the variable pressure chamber of the cylinder to enable an upward and downward sliding motion thereof; and a manual pressure adjustment unit installed on an upper portion of the cylinder to enable a vertical height adjustment to elastically support an upper portion of the piston.

Here, the pressure adjustment means may further include an automatic pressure adjustment unit connected to an air inflow groove which penetrates the cylinder and the contact plug to be positioned above the piston and to automatically adjust a location of the piston.

Also, the automatic pressure adjustment unit may include an air pressure supplier connected to the air inflow groove, which penetrates the cylinder and the contact plug, through an air pressure supplier connection line to be located above the piston; a variable pressure valve installed on the air pressure supplier connection line; and an engine load signaling device connected to the variable pressure valve and an engine.

Further, the manual pressure adjustment means may include a pressure adjustment screw which is screw coupled to the upper portion of the cylinder to be located above the piston, a vertical height of the pressure adjustment screw being adjustable; an elastic member interposed between the piston and the pressure adjustment screw to elastically support the piston with respect to the pressure adjustment screw; and a fixing nut which closely contacts an upper surface of the cylinder and is screw coupled to an upper portion of the pressure adjustment screw to fix the pressure adjustment screw.

As described above, in a fuel injection pump having a variable pressure chamber according to the present invention, by adjusting a vertical height of a pressure adjustment screw of a manual pressure adjustment unit or adjusting an air pressure supplied by an air pressure supplier of an automatic pressure adjustment unit, a distance of a reciprocating motion of a piston and a bush is adjusted so that a volume of the variable pressure chamber is adjusted to achieve an effect of delaying a fuel cam, thereby delaying or advancing a fuel injection timing of a fuel injection pump.

Therefore, a fuel injection pump having a variable pressure chamber according to the present invention is highly useful since the present invention does not have a separate apparatus for moving a barrel and, without modifying a shape of a plunger, may perform complete combustion to achieve an effect of lowering a fuel cost with a simple structure and a lower manufacture cost compared to the conventional injection pump and may reduce generation of NOx while reducing smog which is a harmful gas by adjusting a fuel injection timing according to each engine load, thereby achieving an effect of reducing environmental pollution.

Description of Symbols

| | | | |
|---|---|---|---|
| 10: | pump housing | 11: | barrel |
| 12: | plunger | 13: | upper cover |
| 14: | pressure adjustment means | 15: | fuel oil outlet |
| 16: | delivery valve | 17: | constant valve |
| 140: | contact plus | 141: | cylinder |
| 141a: | variable pressure chamber | 142: | main fuel pressing hole |
| 143: | piston | 144: | manual pressure adjustment unit |
| 144a: | pressure adjustment screw | 144b: | elastic member |
| 144c: | fixing nut | 144d: | bush |
| 144e: | sealing ring | 145: | automatic pressure adjustment unit |
| 145a: | air inlet hole | 145b: | air pressure supplier |
| 145c: | variable pressure valve | 145d: | engine load signaling device |
| 145e: | air pressure supply line | | |

MODE FOR INVENTION

Hereinafter, the present invention will be described herein below with reference to the accompanying drawings. Further, in the following description of the present invention, a detailed description of associated known functions or elements will be omitted when it may make the subject matter of the present invention rather unclear.

Figure 1:
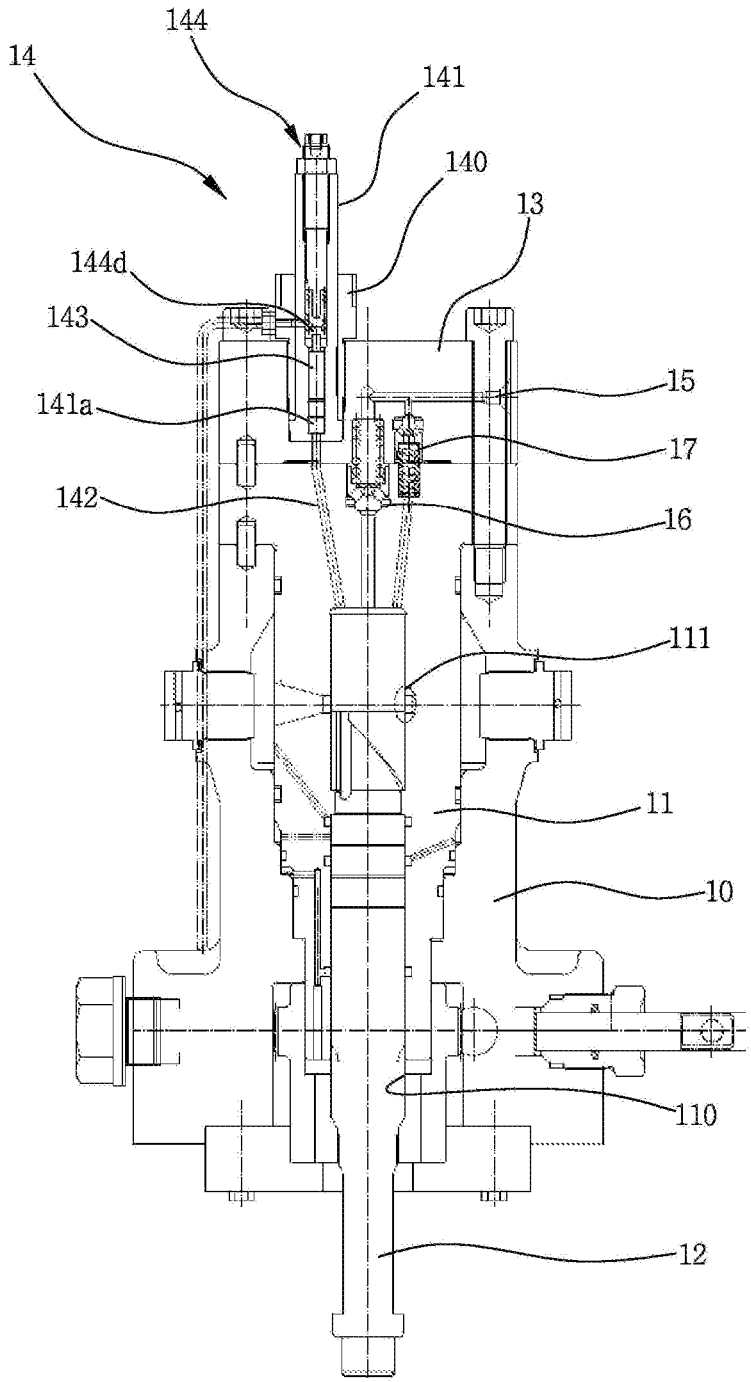
FIG. 1 is a view for explaining a fuel injection pump according to the present invention.
Figure 2:
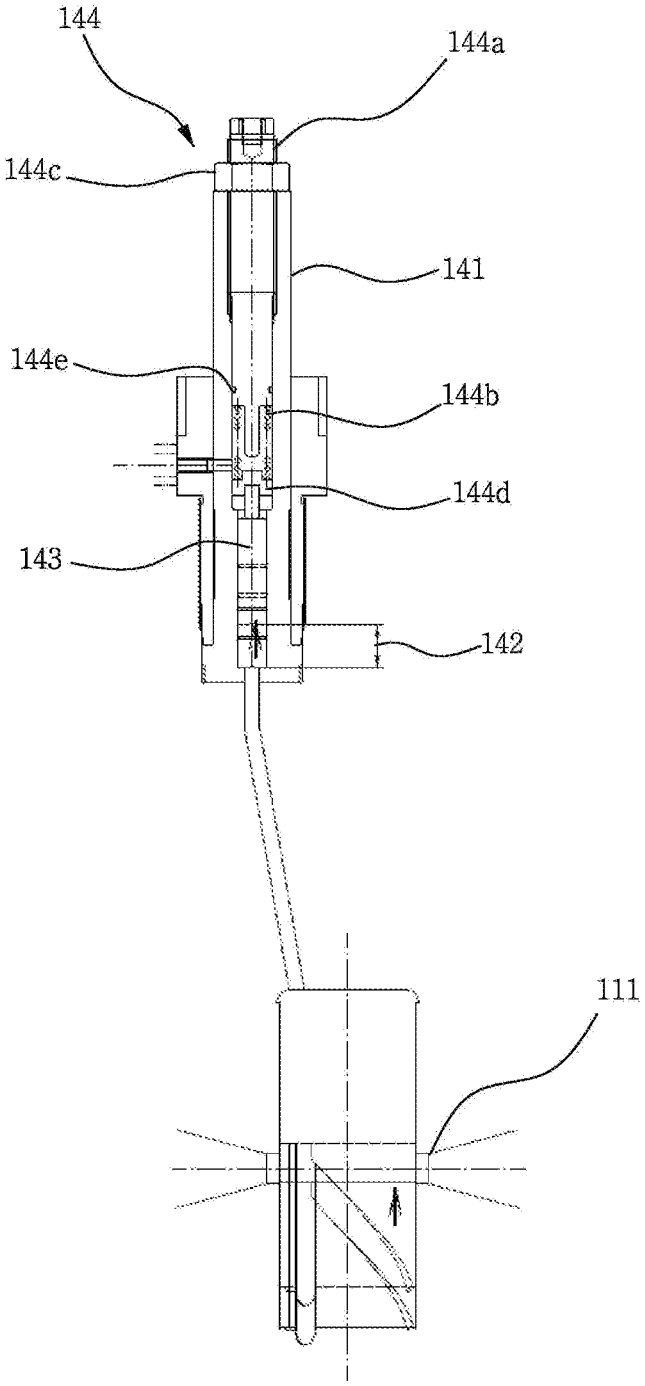
FIG. 2 is a view for explaining a manual pressure adjustment unit of a fuel injection pump according to the present invention.
Figure 3:
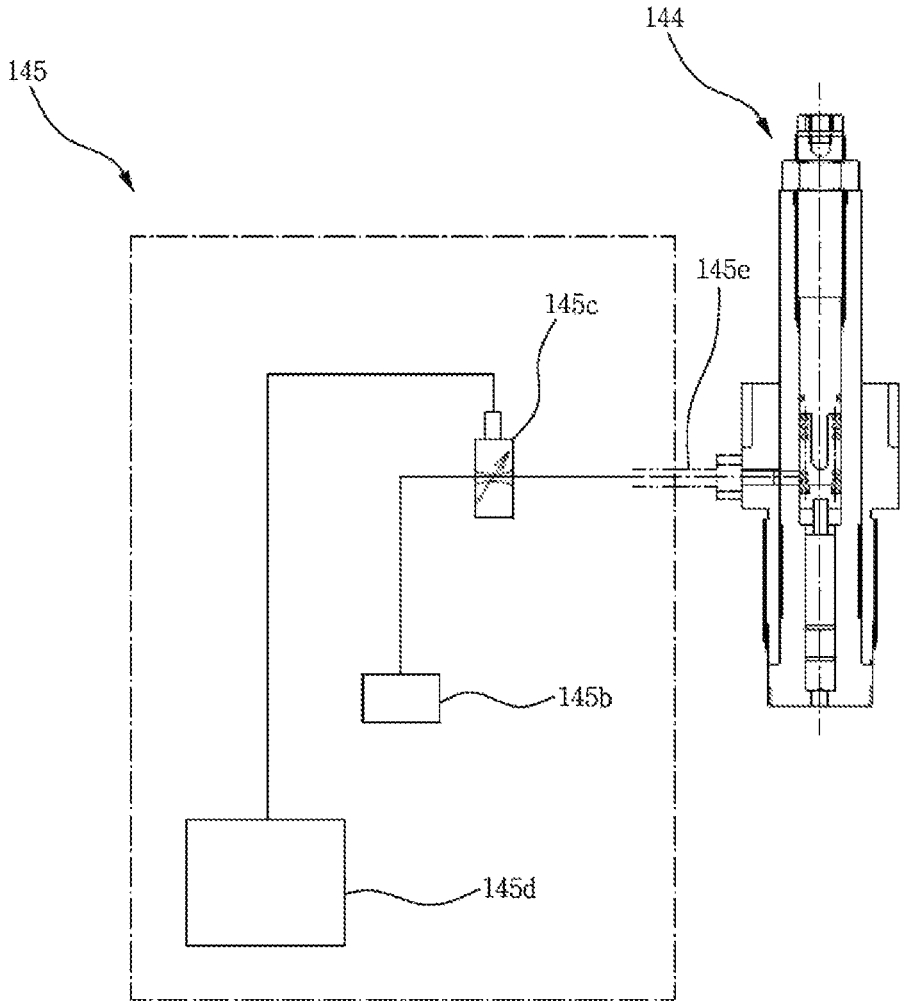
FIG. 3 is a view for explaining an automatic pressure adjustment unit of a fuel injection pump according to the present invention.

FIG. 1 is a view for explaining a fuel injection pump according to the present invention, FIG. 2 is a view for explaining a manual pressure adjustment unit of a fuel injection pump according to the present invention, and FIG. 3 is a view for explaining an automatic pressure adjustment unit of a fuel injection pump according to the present invention.

Referring to FIGS. 1 through 3, a fuel injection pump according to the present invention includes a barrel 11 which is inserted and installed within a pump housing 10, wherein a plunger insertion hole 110 is formed inside thereof, a plunger 12 which is slidably coupled to an inside of the barrel 11, i.e., the plunger insertion hole 110, an upper cover 13 which is coupled to an upper surface of the pump housing 10, and a pressure adjustment means 14 which is installed on the upper cover 13 to connect to the plunger insertion hole 110 of the barrel 11.

Here, the pressure adjustment means 14 includes a contact plug 140, a cylinder 141, a main fuel pressing hole 142, a piston 143, a manual pressure adjustment unit 144, and a lower portion of the contact plug 140 of the pressure adjustment means 14 is inserted and installed in the upper cover 13, and a lower portion of the cylinder 141 is inserted and installed in the contact plug 140, wherein a variable pressure chamber 141*a* is formed inside thereof, and the main fuel pressing hole 142 is formed in the upper cover 13 and the barrel 11 to connect to the variable pressure chamber 141*a* and the plunger insertion hole 110 of the barrel 11, and the piston 143 is installed in the variable pressure chamber 141*a* of the cylinder 141 to enable an upward and downward sliding motion thereof, and the manual pressure adjustment unit 144 is installed on an upper portion of the cylinder 141 to enable a vertical height adjustment so as to elastically support an upper portion of the piston 143.

Also, the pressure adjustment means 14 of the fuel injection pump according to the present invention may further include an automatic pressure adjustment unit 145 connected to an air inlet groove 145*a*, which penetrates the cylinder 141 and the contact plug 140, so as to be positioned above the piston 143 and to automatically adjust a location of the piston.

Here, the automatic pressure adjustment unit 145 may include an air pressure supplier 145*b*, a variable pressure valve 145*c*, and an engine load signaling device 145*d*, and the air pressure supplier 145*b* of the automatic pressure adjustment unit 145 configured as above is connected to the air inlet groove 145*a*, which penetrates the cylinder 141 and the contact plug 140, through an air pressure supplier connection line 145*e* so as to be located above the piston 143, and the variable pressure valve 145*c* is installed on the air pressure supplier connection line 145*e*, and the engine load signaling device 145*d* is connected to the variable pressure valve 145*c* and an engine (not shown).

Also, the manual pressure adjustment unit 144 may include a pressure adjustment screw 144*a*, an elastic member 144*b*, and a fixing nut 144*c*, and the pressure adjustment screw 144*a* of the manual pressure adjustment unit 144 configured as above is screw coupled to the upper portion of the cylinder 141, and the elastic member 144*b* is interposed between the piston 143 and the pressure adjustment screw 144*a* to elastically support the piston 143 with respect to the pressure adjustment screw 144*a*, wherein a bush 144*d* may be further interposed between the piston 143 and the elastic member 144*b*, and the fixing nut 144*c* closely contacts an upper surface of the cylinder 141 and is screw coupled to an upper portion of the pressure adjustment screw 144*a* so as to fix the pressure adjustment screw 144*a*. Also, a sealing ring 144*e* may be further installed at a lower portion of an outer circumference of the pressure adjustment screw 144*a*.

Referring again to FIG. 1 through FIG. 4, an operation process and an operation effect of a pressure adjustment means of a fuel injection pump having a variable pressure chamber according to the present invention are described below.

Figure 4:
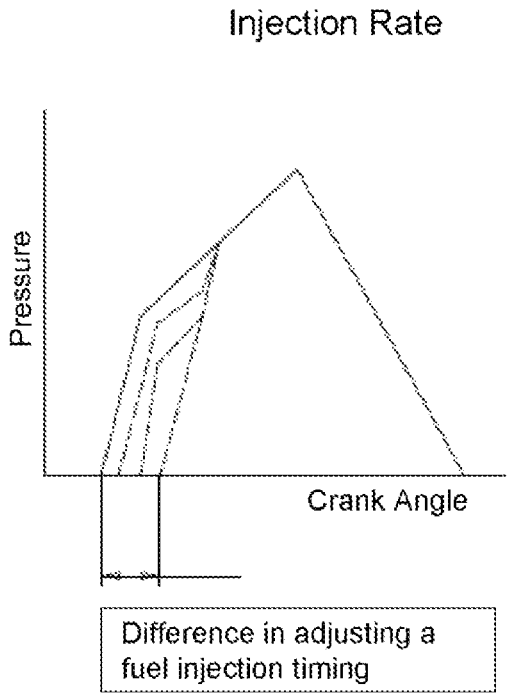
FIG. 4 is a fuel injection rate variable graph according to a location of a variable pressure chamber according to the present invention.

FIG. 4 is a fuel injection rate variable graph according to a location of a variable pressure chamber according to the present invention.

As shown in FIG. 1 through FIG. 3, in a pressure adjustment means of a fuel injection pump having a variable pressure chamber according to the present invention, when an operation of the fuel pump begins, the plunger 12 is raised to pass through a free stroke spill hole 111, and when the free stroke spill hole 111 is closed by the plunger 12 installed within the barrel 11, fuel introduced to the inside of the barrel 11 is pressed by the plunger 12.

As described above, when the fuel within the barrel 11 is pressed by the plunger 12, the pressed fuel is directed to a fuel injection valve (not shown) through a delivery valve 16 and a fuel outlet 15 and an excessive pressure by a pulsation of the fuel injection valve is filtered in a constant valve 17.

At the same time, the pressed fuel within the barrel 11 is introduced to an inside of the pressure adjustment means 14 according to the present invention through the main fuel pressing hole 142 to press the piston 143 of the pressure adjustment means 14.

A pressure of the fuel transmitted to the piston 143 as above is transmitted to the bush 144*d* such that the piston 143 is raised by the pressure of the fuel and the bush 144*d* is raised with the piston 143 in association therewith, and thus, the elastic member is compressed by the bush 144*d*.

Here, a distance of a reciprocating motion (stroke) of the piston 143 and the bush 144*d* is adjusted by the pressure adjustment screw 144*a* of the manual pressure adjustment unit 144. Namely, the pressure adjustment screw 144*a* of the manual pressure adjustment unit 144 is rotated to further descend to an inside of the cylinder 141, the elastic member 144*b* is pressed and compressed by the pressure adjustment screw 144*a* such that the distance of the reciprocating motion of the piston 143 and the bush 144*d* is reduced, and when the pressure adjustment screw 144*a* of the manual pressure adjustment unit 144 is rotated to ascend outwardly from the cylinder 141, a distance between the pressure adjustment screw 144*a* and the bush 144*d* is increased as much as a distance by which the pressure adjustment screw 144*a* is raised such that the elastic member 144*b* expands to increase the distance of the reciprocating motion of the piston 143 and the bush 144*d*.

Also, the distance of the reciprocating motion (stroke) of the piston 143 and the bush 144*d* may be adjusted by the automatic pressure adjustment unit 145. In other words, by opening and closing the variable pressure valve 145*c* upon receiving a signal of the engine load signaling device 145*d* of the automatic pressure adjustment unit 145, an air pressure generated by the air pressure supplier 145*b* is provided between the pressure adjustment screw 144*a* and the bush 144*d* through the air pressure supply line 145*c* to adjust the distance of the reciprocating motion of the piston 143 and the bush 144*d*. In other words, when the air pressure supplied between the pressure adjustment screw 144*a* and the bush 144*d* by the air pressure supplier 145*b* is increased, a force which presses the piston 143 is increased, thereby decreasing the distance of the reciprocating motion of the piston 143 and the bush 144*d*, and when the air pressure supplied between the pressure adjustment screw 144*a* and the bush 144*d* by the air pressure supplier 145*b* is decreased, the force which presses the piston 143 is decreased, thereby increasing the distance of the reciprocating motion of the piston 143 and the bush 144*d*.

As described above, in a fuel injection pump having a variable pressure chamber according to the present invention, by adjusting a vertical height of the pressure adjustment screw 144*a* of the manual pressure adjustment unit 144 or by adjusting the air pressure supplied by the air pressure supplier 145*b* of the automatic pressure adjustment unit 145, the distance of the reciprocating motion of the piston 143 and the bush 144*d* is adjusted to adjust a volume of the variable pressure chamber 141*a* such that an effect of delaying a fuel cam is achieved, as shown in FIG. 4, thereby delaying or advancing a fuel injection timing of the fuel injection pump.

Therefore, a fuel injection pump having a variable pressure chamber according to the present invention does not have a separate apparatus for moving a barrel and, without modifying a shape of a plunger, may perform complete combustion to achieve an effect of lowering a fuel cost with a simple structure and a lower manufacture cost compared to the conventional injection pump as well as the present invention may reduce generation of NOx while reducing smog which is a harmful gas by adjusting a fuel injection timing according to each engine load, thereby achieving an advantage of reducing environmental pollution.

The present invention is not limited to particular preferable exemplary embodiments described above and it will be understood by those of ordinary skill in the art that various modifications may be made without departing from the spirit and scope of the present invention as defined by the following claims.

The invention claimed is:

1. A fuel injection pump having a variable pressure chamber, comprising:

a barrel inserted and installed within a pump housing;

a plunger slidably coupled to an inside of the barrel; and an upper cover coupled to an upper surface of the pump housing, wherein the plunger closes a discharge hole of the barrel to begin a pressure increase of fuel to inject high pressure fuel, the fuel injection pump further comprising:

a pressure adjustment means comprising:

a contact plug of which a lower portion is inserted and installed in the upper cover;

a cylinder of which a lower portion is inserted and installed in the contact plug and having the variable pressure chamber formed inside thereof;

a main fuel pressing hole formed in the upper cover and the barrel to connect the variable pressure chamber of the cylinder and a plunger insertion hole of the barrel;

a piston installed in the variable pressure chamber of the cylinder to enable an upward and downward sliding motion thereof; and a manual pressure adjustment unit installed on an upper portion of the cylinder to enable a vertical height adjustment to elastically support an upper portion of the piston.

2. The fuel injection pump of claim 1, wherein the pressure adjustment means further comprises:

an automatic pressure adjustment unit connected to an air inflow groove which penetrates the cylinder and the contact plug to be positioned above the piston and to automatically adjust a location of the piston.

3. The fuel injection pump of claim 2, wherein the automatic pressure adjustment unit comprises:

an air pressure supplier connected to the air inflow groove, which penetrates the cylinder and the contact plug, through an air pressure supplier connection line to be located above the piston;

a variable pressure valve installed on the air pressure supplier connection line; and an engine load signaling device connected to the variable pressure valve and an engine.

4. The fuel injection pump of claim 2, wherein the manual pressure adjustment means comprises:

a pressure adjustment screw which is screw coupled to the upper portion of the cylinder to be located above the piston, a vertical height of the pressure adjustment screw being adjustable;

an elastic member interposed between the piston and the pressure adjustment screw to elastically support the piston with respect to the pressure adjustment screw; and a fixing nut which closely contacts an upper surface of the cylinder and is screw coupled to an upper portion of the pressure adjustment screw to fix the pressure adjustment screw.

* * * * *